US005947231A

United States Patent [19]

Raab et al.

[11] Patent Number: 5,947,231

[45] Date of Patent: Sep. 7, 1999

[54] PIVOTING WHEEL CHAIR LIFT DEVICE

[75] Inventors: Richard Jerome Raab, Sherwood; Dennis Alan Hase, Neenah, both of Wis.

[73] Assignee: Raase Lifts, Sherwood, Wis.

[21] Appl. No.: 08/938,146

[22] Filed: Sep. 26, 1997

Related U.S. Application Data

[60] Provisional application No. 60/027,279, Sep. 27, 1996.

[51] Int. Cl.[6] ..... B66B 9/08

[52] U.S. Cl. ..... 187/200; 414/921

[58] Field of Search ..... 187/200, 201, 187/269; 414/921, 545; 180/268, 270

[56] References Cited

U.S. PATENT DOCUMENTS

| | | | |
|---|---|---|---|
| 2,689,965 | 9/1954 | Fenton | 14/71 |
| 3,888,463 | 6/1975 | O'Brien et al. | 254/10 |
| 3,997,932 | 12/1976 | Artzberger | 14/71.3 |
| 4,081,091 | 3/1978 | Thorley | 214/75 |
| 4,155,468 | 5/1979 | Royce | 414/556 |
| 4,180,366 | 12/1979 | Roth et al. | 414/540 |
| 4,457,402 | 7/1984 | Del Vecchio et al. | 187/12 |
| 4,479,753 | 10/1984 | Thorley | 414/541 |
| 4,559,659 | 12/1985 | Hunter, Jr. | 14/71.3 |
| 4,576,539 | 3/1986 | Williams | 414/391 |
| 4,958,979 | 9/1990 | Svensson | 414/549 |
| 5,105,915 | 4/1992 | Gary | 187/18 |
| 5,230,522 | 7/1993 | Gehlsen et al. | 187/200 |
| 5,806,632 | 9/1998 | Budd et al. | 187/200 |

*Primary Examiner*—Kenneth Noland
*Attorney, Agent, or Firm*—Thomas D. Wilhelm

[57] ABSTRACT

This invention provides a pivoting wheel chair lift device for raising a wheel chair from a lower elevation to a higher elevation. The wheel chair lift device includes a frame, a ramp, and lift powering apparatus. The third end of the ramp is disposed toward the ground engaging first end of the frame. The fourth end of the ramp is pivotally mounted to the second upper end of the frame. The lift powering apparatus lifts the third end of the ramp. An arresting plate arrests egress of a wheel chair during lifting. A gravity locking bracket and locking receptacle combination lock the arresting plate when engaged. The lift powering apparatus may power the arresting plate and the ramp through two divergent linkages. The fourth end of the ramp can extend over a step to align the ramp with an upper step enabling a wheel chair to roll safely from the ramp to and across the step tread. The invention also comprehends methods of negotiating steps with a wheel chair. The methods include placing a pivoting wheel chair lift device propinquant a top step; advancing the chair onto the ground level ramp end; activating the control apparatus to lift the ramp, and advancing the wheel chair to the other end of the ramp.

47 Claims, 7 Drawing Sheets

PIVOTING WHEEL CHAIR LIFT DEVICE

This application claims priority under 35 U.S.C. 120 from Provisional Application Ser. No. 60/027,279, filed Sep. 27, 1996, herein incorporated by reference in its entirety.

FIELD OF THE INVENTION

This invention relates to apparatus and methods for negotiating steps with wheel chairs. More specifically, this invention relates to ramps for by-passing steps between a lower level and a higher level, especially for accessing steps for entrance into a building, or for negotiating across steps within a building.

BACKGROUND OF THE INVENTION

It is known to build a long, permanent ramp for entrance into a building. While negotiating such ramp may be entirely feasible for a person in a motor-driven wheel chair, a large percentage of wheel chair users are without motor drive. For such users, negotiating wheel chair ramps is a physically challenging task which they may not be able to fulfill. Thus, for such a wheel chair user, such inclined ramps are as much a barrier as are the steps.

It is also known to provide permanent installation lift devices which remain in a horizontal orientation when lifting a wheel chair user to the higher level. However, such devices are quite massive, and respectively expensive.

It is known to provide a simple ramp which pivots about the lower elevation, from which access is to be had into the building. However, such ramp requires special construction of both the steps and the underlying support at the lower elevation, and thus such ramp requires a relatively costly installation.

It is an object of this invention to provide an improved wheel chair lift device which is light in weight, simple to construct, and simple to install and use.

It is another object to provide a wheel chair lift device which operates as an inclined ramp for negotiating between upper and lower elevations, and which operates as a powered lift for negotiating from the lower elevation to the higher elevation, as well as from the higher elevation to the lower elevation.

It is yet another object to provide a lift device which provides for the user to advance onto the ramp in a generally horizontal orientation at an entrance element thereof, up to a rising element thereof, and then to activate a lift mechanism to raise the ramp, and thus the rising element thereof, to a more nearly horizontal orientation, for traverse of the rising element of the ramp by the wheel chair user with minimal expenditure of effort.

It is yet another object to provide a lift device having provision for raising and mechanically locking an arrestor plate, to prevent inadvertent egress of the wheel chair off the lower end of the ramp when the lower end of the ramp is lifted off the ground, in the lift mode.

It is still another object to provide such a lift device which is modular, self-contained, and portable from place-to-place, and which thus may be moved from place-to-place for temporary uses, with little if any installation cost or effort.

It is yet a further object to provide a lift device which can be adjusted for accessing a range of heights of steps.

SUMMARY OF THE INVENTION

One aspect of the invention is generally defined in a pivoting wheel chair lift device articulated and powered to pivot about an upper end thereof from an inclined orientation to a horizontal orientation and thereby to lift a person in a wheel chair from a lower elevation to a higher elevation. The pivoting wheel chair device includes a frame, a ramp, and a lift powering apparatus. The frame has a first lower ground engaging end, a second upper end laterally displaced from the first end and disposed at a higher elevation than the first end.

The ramp, has a third end disposed toward the first end of the frame, and a fourth opposing upper end mounted to the frame adjacent the second end of the frame, for pivotation of the ramp about the second end of the frame.

The lift powering apparatus is operable to lift the third end of the ramp from a lowered position in which the ramp describes an inclined angle between a first lower elevation at the third end of the ramp and a second higher elevation at the fourth end of the ramp, to a lifted position in which the third end is lifted to an elevation higher than the first elevation.

In some embodiments, the lift powering apparatus may power the arresting plate and the ramp through divergent first and second linkages having first and second separate terminal ends thereof operative to lift the tail of the arresting plate and the fourth end of the ramp, respectively.

Further, the lift powering apparatus powers the arresting plate through a first linkage to a first receptor at the arresting plate using a first force, and powers the ramp through a second linkage using a second force without exposing the first receptor to the second force.

In preferred embodiments, the frame generally engages the ground, and extends upwardly from the ground adjacent the second end of the frame to define an opening across the width of the ramp at the fourth end, sufficient to receive a first step, for example about 12 inches wide by 10 inches high, extending transverse to the length of the ramp. Thus, the second end of the frame, and thus the respective end of the lift device, can extend over the step and abut an upper step such that the upper surface of the ramp at the fourth end of the ramp is aligned with the upper surface of the tread of the upper one of the steps. Namely, the lift device may be placed at least propinquant the upper surface of the tread of the upper step, whereby the upper end of the lift device is close enough to the upper step to enable safe rolling of a wheel chair across the joint defined between the upper end of the lift device and the tread of the step.

The ramp preferably includes an entrance element, and a rising element. When the third end of the ramp is in ground-engaging disposition, the entrance element is disposed more or less parallel with the ground, and extends inwardly from the third end of the ramp; and the rising element extends from the entrance element toward the fourth end at an upwardly inclined angle to the ground.

The angle between the entrance element and the rising element is preferably about 5 degrees to about 20 degrees, more preferably about 8 degrees to about 15 degrees.

The lift device preferably includes control apparatus activating the lift powering apparatus, and thereby activating the wheel chair lift device. The lift powering apparatus is preferably mounted to the frame.

The lift devices are preferably modular, portable, self-contained units requiring, for installation, only placement of the lift device in the desired location, and attachment of an associated power lead to suitable power source, such as plugging in an electric power cord to an electric power grid, namely plugging the cord into a standard 110 volt outlet.

The lift device preferably includes an arresting plate, having a fifth end mounted to the ground-engaging end of the ramp, and a sixth opposing tail end remote from the ground-engaging end of the ramp, the arresting plate being mounted for pivotation about the ground-engaging end of the ramp, from a first horizontal orientation to a lifted orientation wherein the sixth tail end of the arresting plate is above the fifth end of the arresting plate. The arresting plate arrests egress of a wheel chair from the first end of the ramp while the ramp is off the ground on other underlying support surface such as a floor. The arresting plate also functions as an entrance element for entrance onto the ramp.

The lift device preferably includes a gravity locking bracket on the arresting plate, and a locking receptacle on the ramp. The locking receptacle engages the locking bracket as the third end of the ramp is lifted, thereby mechanically locking the arresting plate in a raised orientation when the third end of the ramp is lifted. The combination could as well have the locking bracket on the ramp and the locking receptacle on the arresting plate. Any functionally operable gravity actuated locking devise is satisfactory.

The invention further comprehends a method of negotiating steps with a wheel chair. The method comprises the steps of placing a pivoting wheel chair lift device propinquant an upper one of the steps, the pivoting wheel chair lift comprising (i) a frame having a first lower, ground engaging end, a second upper end laterally displaced from the first end and disposed at a higher elevation than the first end, (ii) a ramp, having an upper surface thereof, having a third end at ground level adjacent the first end of the frame and a fourth opposing upper end mounted to the frame adjacent the second end of the frame for pivotation of the ramp about the second end of the frame, the fourth end of the upper surface of the ramp being disposed substantially at the elevation of the upper surface of the tread of the upper one of the steps such that the ramp describes a first inclined angle between the third and fourth ends thereof, (iii) lift powering apparatus operable to lift the first end of the ramp from ground level to a higher elevation; and (iv) control apparatus for activating the lift powering apparatus, and thereby lifting the wheel chair ramp; advancing a wheel chair onto the ramp at the first lower end thereof while the ramp is inclined between ground level at the third end thereof and step level at the fourth end thereof; after advancing the wheel chair onto the lift device, activating the control apparatus to thereby lift the third end of the ramp, with corresponding pivoting of the fourth end to thereby reduce the angle of incline; and advancing the wheel chair to the fourth end of the ramp along a second angle less than the first angle, thence onto the upper one of the steps.

In preferred embodiments, the ramp has an entrance element substantially parallel with the ground and extending inwardly from the third end of the ramp, and a rising element extending from the entrance element toward the fourth end of the ramp at an angle inclined upwardly from ground, and the method includes the step of activating the control apparatus to thereby lift the fourth end of the ramp while at least part of the wheel chair is supported on the entrance element.

DETAILED DESCRIPTION OF THE ILLUSTRATED EMBODIMENTS

Figure 1:
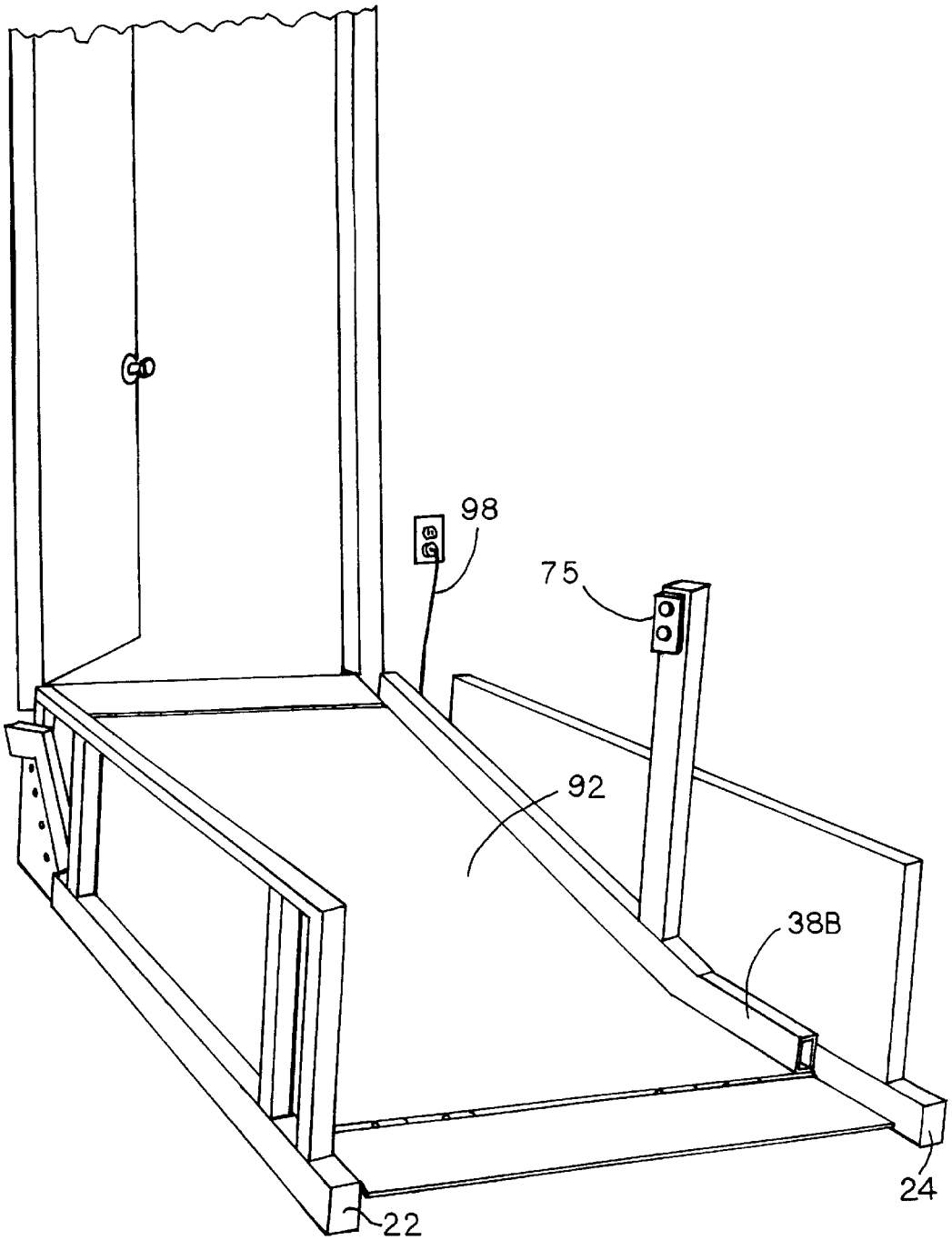
FIG. 1 shows a pictorial view of a pivoting wheel chair lift device of the invention.
Figure 2:
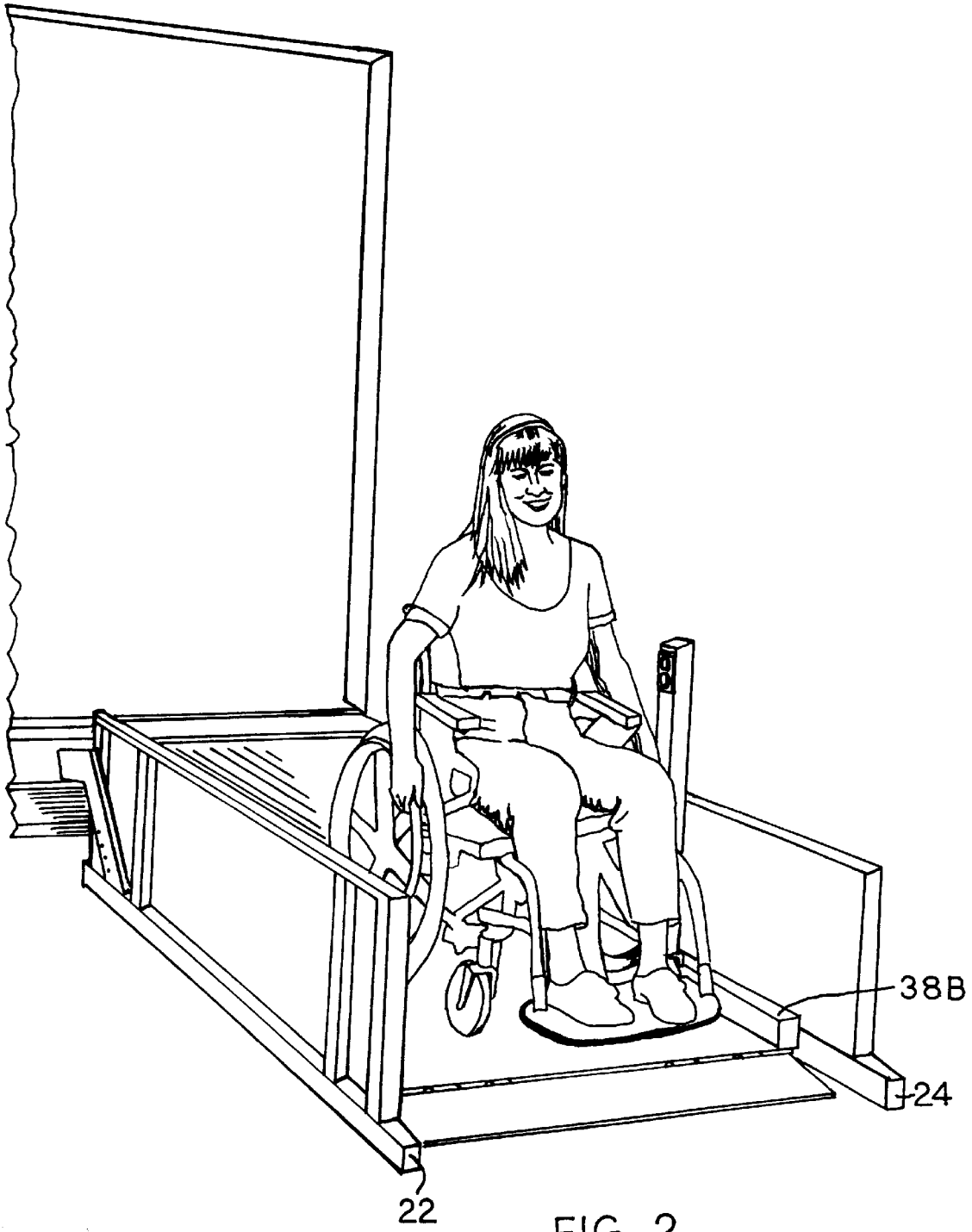
FIG. 2 shows a pictorial view as in FIG. 1, with a person in a wheel chair negotiating the ramp in a downward direction.
Figure 3:
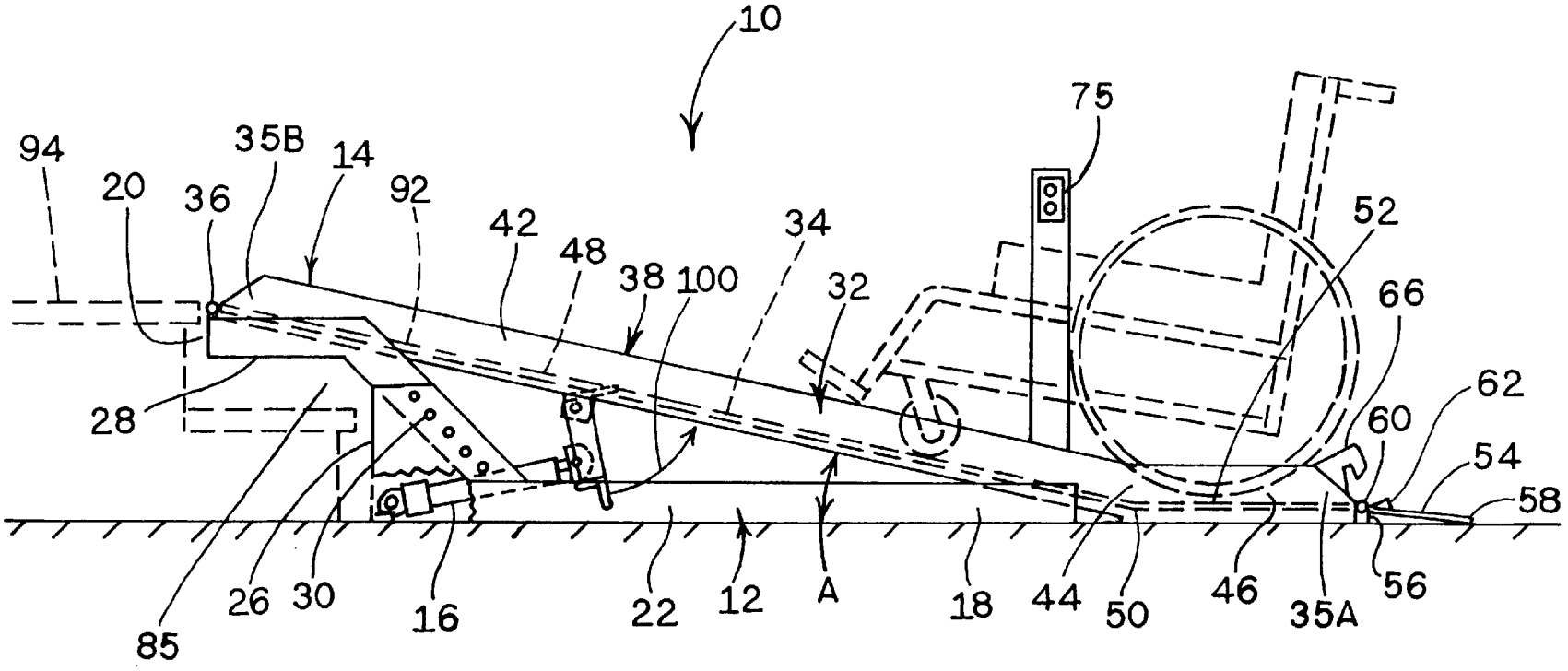
FIG. 3 shows a side elevation view of the lift device of FIG. 1, with parts cut away, and the lower end of the ramp down.
Figure 4:
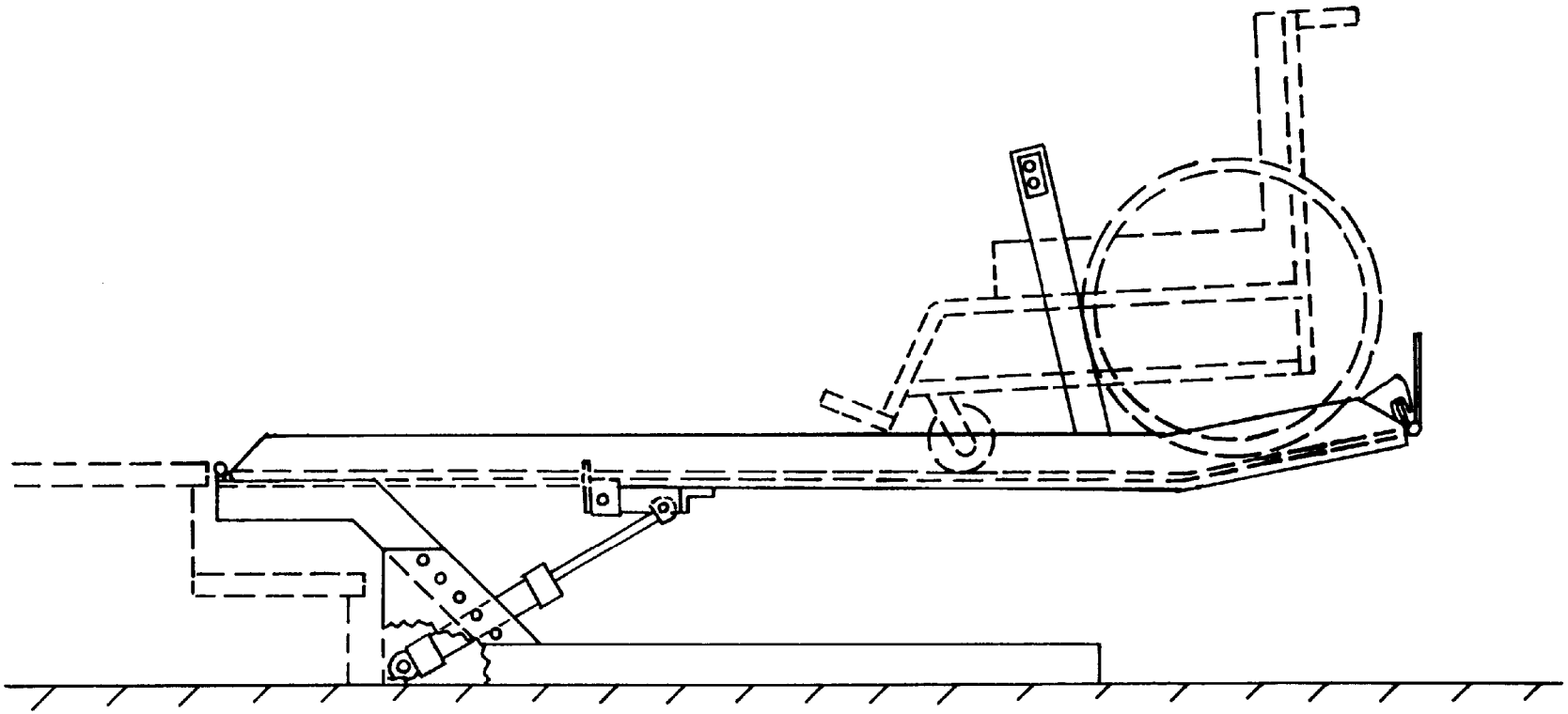
FIG. 4 shows a side elevation as in FIG. 3, with the lower end of the ramp lifted.

Referring to FIGS. 1–3, a pivoting wheel chair lift device 10 includes a lift frame 12, a ramp 14, and lift powering apparatus 16.

Lift frame 12 has a first lower ground engaging end 18 and a second upper end 20 laterally displaced from the first end, and disposed at a higher elevation than the first end as shown in FIG. 3.

Lift frame 12 includes first and second ground engaging members 22, 24 and suitable cross-connecting members (not shown) extending between, and joining, ground engaging members 22, 24. Adjustment gussets 26 are mounted to ground engaging members 22, 24 at the ends thereof remote from the first end of the frame. Frame extension arms 28 are mounted to adjustment gussets 26 through two or more of mounting holes 30. Five mounting holes are shown on gusset 26. Suitable holes also extend through extension arms 28 for alignment with holes 30 on gussets 26. More or fewer holes can be used in either or both of extension arms 28 and gussets 26 to provide more or less options for mounting extension arms 28 to gussets 26. The height of second upper end 20 of the frame, and thus the height of the upper end of the ramp, can be adjusted by selecting suitable ones of the holes to be used in mounting extension arms 28 to respective adjustment gussets 26.

Ramp 14 generally includes ramp frame 32 and ramp plate 34. Ramp 14 generally extends from a third, generally lower end 35A, disposed toward first end 18 of lift frame 12, to a fourth opposing upper end 35B. Fourth upper end 35B is mounted to lift frame 12 at pivot pin 36, at second upper end 20 of lift frame 14, for pivotation about the second end of the lift frame.

Ramp frame 32 includes stringers 38A, 38B, and a plurality of cross members 40 extending between and connecting stringers 38A, 38B. Referring to FIGS. 3 and 7–9, stringers 38A, 38B generally extend the full length of ramp 14, with cross members 40 extending between and connecting stringers 38A, 38B at spaced intervals. As illustrated in FIGS. 1–4, each stringer 38A, 38B extends in a generally straight line along an upper section 42 from fourth upper end 35B to a generally ground engaging intermediate locus 44, disposed toward, but spaced from, third lower end 35A of the ramp. From intermediate locus 44, stringers 38A, 38B extend along a lower section 46, generally along the ground, at an angle to the upper section 42, toward third end 35A of the ramp.

Ramp plate 34 generally rests on, and is mounted to, cross members 40, and is secured at its opposite side edges to stringers 38A, 38B. Accordingly, ramp plate 34, stringers 38A, 38B, and cross members 40 generally form an integral unit, wherein general structural strength is provided by stringers 38A, 38B and cross members 40, and the supporting surface is provided by plate 34. Within the integral structure of the ramp as a unit, plate 34 provides certain strengthening of the ramp against side-to-side twisting.

Ramp plate 34 generally extends nearly the full length of ramp 14, from fourth end 35B to nearly third end 35A as further discussed hereinafter. As with stringers 38A, 38B, ramp plate 34 extends in a generally straight line along a sloping section 48 from fourth upper end 35B to a generally ground engaging intermediate locus 50, disposed toward, but spaced from, third lower end 35A of the ramp. From intermediate locus 50, plate 34 extends along a generally horizontal section 52, generally along the ground, at an angle to the sloping section 48, to near the third end 35A of the ramp.

The angles described between the upper and lower runs of a stringer 38A or 38B, and between generally horizontal section 52 and sloping section 48 of the plate, are generally the same or similar. For purposes of this teaching, it will be assumed that the angles are the same, and are represented by angle "A" in FIG. 3. The angles could, of course, be different if desired. Especially the angle described by stringers could readily be changed by redesign of ramp frame 32. The angle described by ramp plate, is generally as shown and described here.

Referring now to FIG. 3, angle "A" is generally between about 5 degrees and about 20 degrees. Preferred angles are between about 8 degrees and about 25 degrees. A most preferred angle is about 11 degrees. Outside the upper end of the range of angles, where the angle is greater than about 20 degrees, the incline when the ramp is in the lowered orientation, as shown in FIG. 3, is so great as to suggest an unsafe condition. Thus, a wheel chair on the ramp, with the rear wheels on the generally horizontal section and the front wheels on the sloping section, as suggested in FIG. 3, may tip over unless the generally horizontal section of ramp plate 34 is further elongated beyond that shown to accommodate retaining both front and rear wheels on the generally horizontal section during the lifting operation.

At the lower end of the range of angles, the length of the ramp is unnecessarily increased with little if any advantage.

Arresting plate 54 is part of ramp 14, and includes a fifth mounting end 56 and a sixth opposing tail end 58. Arresting plate 54 is mounted at its fifth mounting end to section 52 of ramp plate 14 at pivot pin 60, for pivotation about ramp section 52. Accordingly, the distal edge of arresting plate 54 corresponds with the third lower end of the ramp.

Figure 5:
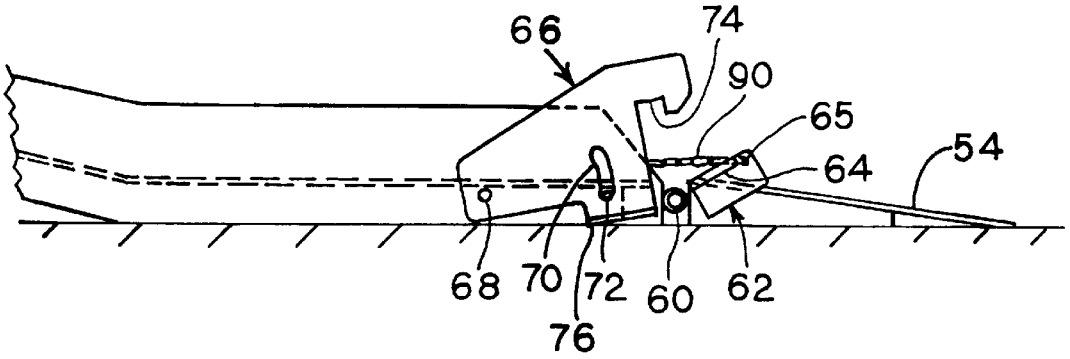
FIG. 5 shows an enlarged fragmentary side elevation, illustrating the arresting plate and lock, with the arresting plate unlocked, and disposed in its lowered orientation.
Figure 6:
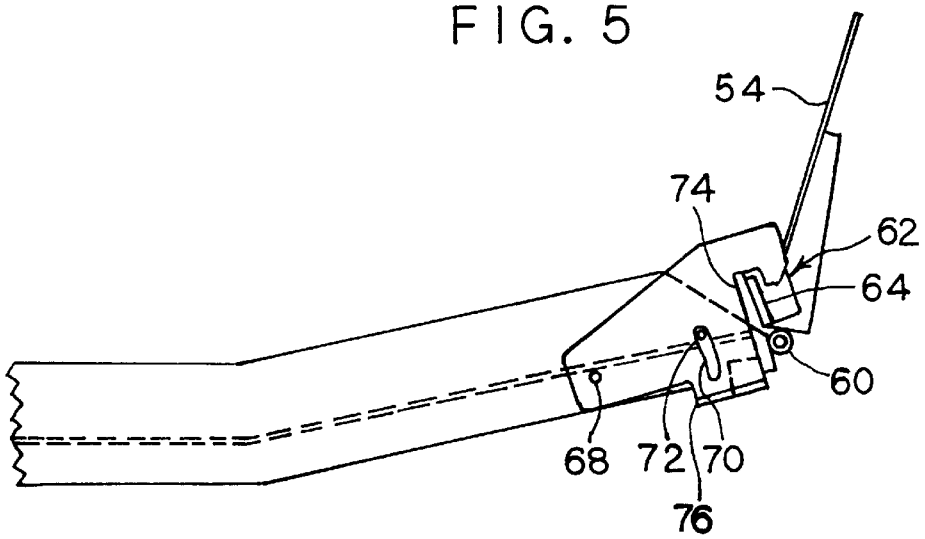
FIG. 6 shows an enlarged fragmentary side elevation as in FIG. 5, with the ramp raised and the arresting plate locked, and disposed in its raised orientation.

Gravity locking bracket 62 is rigidly mounted, for example welded, to arresting plate 54 such that pivotation of arresting plate 54, as suggested by comparison of FIGS. 5 and 6, effects corresponding pivotation of locking bracket 62 with the arresting plate. Bracket 62 includes locking flange 64, locking flange 64 being seen in edge view in FIGS. 3, 5, and 6. Bracket 62 further includes aperture 65 adjacent an upper end of bracket 62.

Locking receptacle 66 includes an arcuate slot 70. Locking receptacle 66 is mounted to stringer 38B at pivot pin 68, and with stud 72 extending from stringer 38B through slot 70, such that arcuate slot 70 describes an arc receiving about pivot pin 68, for rotation of the locking receptacle within the arc defined by slot 70 and confined by stud 72.

Locking receptacle 66 includes locking recess 74 having an open end extending downwardly generally toward pivot pin 60, as illustrated in FIGS. 3–6.

Locking receptacle 66 further includes ground stop 76. Stop 76 engages the ground or other Respective underlying surface when the ramp is in the lowered disposition as shown in FIGS. 3 and 5, and is released from such engagement when the ramp is raised such as to the raised disposition shown in FIGS. 4 and 6.

Locking bracket 62 and locking receptacle 66 are so cooperatively configured, mounted, and aligned that pivoting arresting plate 54 upwardly about pivot pin 60 brings locking flange 64 on locking bracket 62 into alignment with locking recess 74 on locking receptacle 66. While a specific example of locking bracket and receptacle has been described, any functionally effective gravity activated lock mechanism is satisfactory so long as arresting plate 54 is mechanically locked in the lifted, upright orientation.

Figure 8:
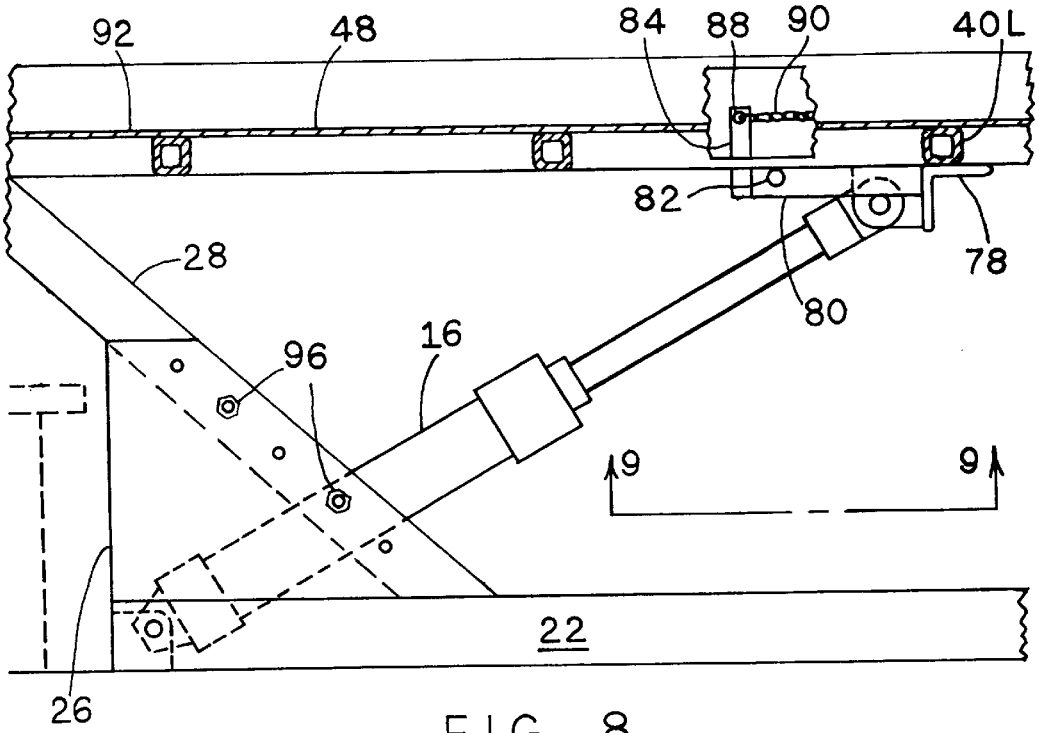
FIG. 8 shows an enlarged fragmentary side elevation as in FIG. 7, with the lower end of the ramp lifted.
Figure 7:
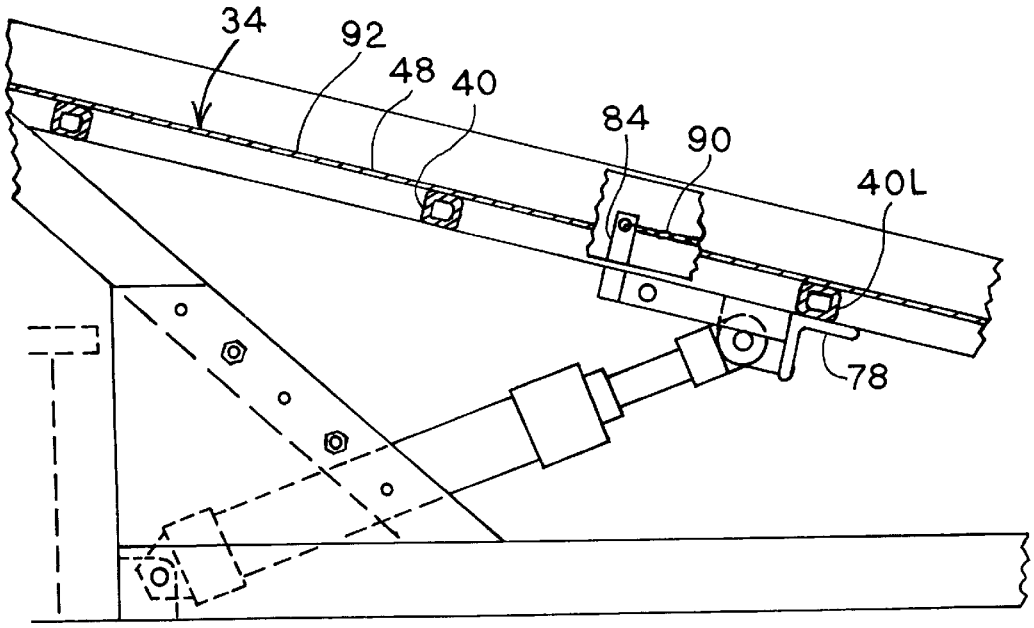
FIG. 7 shows an enlarged fragmentary side elevation, illustrating the ram linkage for lifting the ramp and the arresting plate, with the ram partially activated to raise the arresting plate, but with the lower end of the ramp still on the ground.
Figure 9:
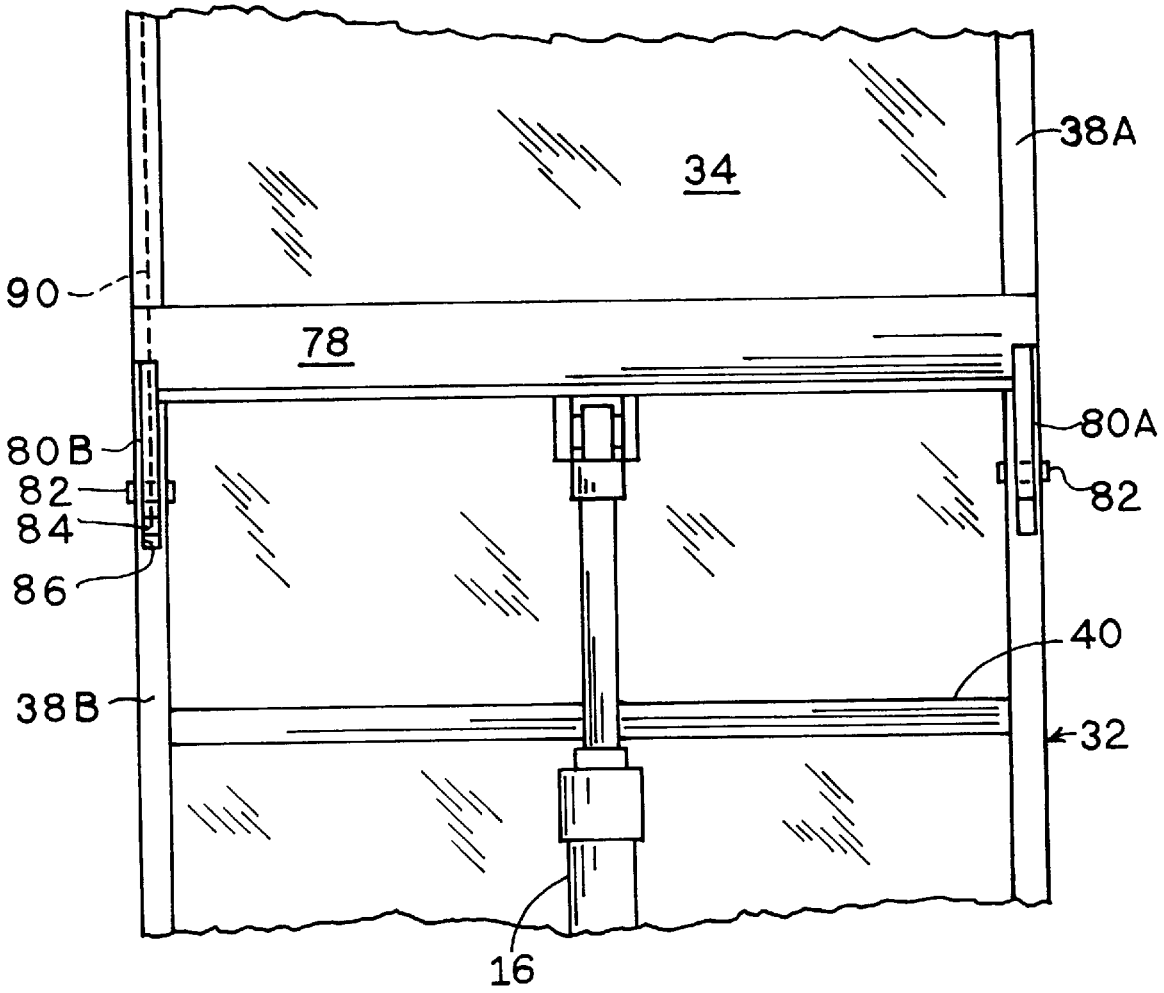
FIG. 9 is a bottom view of the ram linkage, taken at 9—9 of FIG. 8.

Referring now to FIGS. 7–9, lift powering apparatus 16 preferably comprises a hydraulic cylinder as shown, including a self-contained hydraulic pumping unit (not shown), and suitable and conventional control apparatus for turning the hydraulic unit on and off, and for otherwise controlling the hydraulic cylinder. Hereinafter the lift powering apparatus will be referred to as hydraulic cylinder 16. A preferred hydraulic cylinder has a delayed bleed-back, which will bleed the hydraulic fluid back to a rest condition with the ram retracted, after a desired time. It will be appreciated that other power sources, and other types of hydraulic and other cylinders may be used as desired for any particular application.

The hydraulic cylinder is connected at its lower end to lift frame 12 as illustrated in FIGS. 7–8, and is connected at its upper end to weight lifting bar 78. Lifting bar 78 is connected at its opposing distal ends to rotation brackets 80. Pivotation brackets 80A, 80B are mounted to respective stringers 38A, 38B at pivot pins 82, for pivotation of pivotation brackets 80A, 80B, and thus lifting bar 78, with respect to stringers 38A,38B.

Chain arm 84 is mounted to pivotation bracket 80B and extends upwardly therefrom as illustrated in FIGS. 3, 7, and 8, into stringer 38B, through a slot 86 in the bottom of stringer 38B. Aperture 88 extends through chain arm 84. Chain 90 is secured to chain arm 84 in aperture 88, and extends, through the open tubular structure of stringer 38B, to third end 35A of the ramp. Adjacent third end 35A, chain 90 is secured to gravity locking bracket 62 in aperture 65 (FIG. 5). Thus, chain 90 provides a controlling connection between hydraulic cylinder 16, through lifting bar 78, pivotation bracket 80B, and chain arm 84, to arresting plate 54 through locking bracket 62, including through locking flange 66. A similar chain 90 can likewise be installed through stringer 38A if desired.

Wheel chair lift device 10 is a unitary module, is generally self-contained, and requires only access to an appropriate source of power to drive the hydraulic cylinder. Accordingly, lift device 10 is quite mobile, is quite portable, and is quick and easy to install. The lift device may be used directly on the ground, on a floor of a building, or on a concrete pad such as a sidewalk, a driveway, or the like. In a building, the lift device may be used on any floor, including an underground floor, the ground floor, or any floor above ground level where one or more steps are to be negotiated.

The lift device 10 illustrated in the drawings can be installed in two simple steps. The first step is to place the lift device on a suitable underlying surface, with the second upper end 20 of the frame propinquant, and generally abutting the upper one of the step or steps to be negotiated. The height of upper end 20 is adjusted as desired such that upper surface 92 of ramp plate 34 at the upper end 20 of lift frame 12 is aligned with the upper surface of tread 94 of the upper one of the steps to be negotiated. The height adjustment is affected as follows. Bolts 96, extending through gussets 26 and extension arms 28 at holes 30, are first removed. Then the height is adjusted as desired by moving extension arms 28 along gussets 26 until the desired height is reached, and new sets of holes are aligned in gussets 26 and extension arms 28 at the desired height. Bolts 96 are then inserted and secured in the aligned holes, securing the desired the height at the second end of the ramp.

With the height adjustment made, the lift device is again moved into general abutment with the steps such that the pivot joint at pivot pin 36 is generally against the upper step as illustrated in the drawings. The power cord 98 is then connected to a standard 110 volt alternating current electric outlet, such as by plugging it in, thereby connecting to the power grid, and thus providing power to the motor which drives the hydraulic cylinder. Assuming the hydraulic cylinder is a bleed-back type unit, the cylinder has a normal rest position in which the ram is retracted into the cylinder housing as illustrated in FIGS. 3 and 7. In that position, and as shown in FIGS. 3 and 7, third end 35A of the ramp is down, generally in contact with the ground.

Locking bracket 62 and locking receptacle 66 are in relative positions best shown in FIG. 5. Similarly, arresting plate 54 is down, as illustrated in FIGS. 3 and 5.

Pivotation brackets 80 and lifting bar 78 are pivoted away from the bottom of ramp 14, and thus away from the respective cross member 40 against which lifting bar 78 interfaces in its up and working position. Correspondingly, chain arm 84 extends toward the lower end of the ramp (FIG. 3). The above combination of dispositions of the hydraulic cylinder, pivotation brackets 80, and lifting bar 78, is illustrated in FIG. 3.

The lift device is then ready for use, with the ramp describing an incline between ground level and the fourth upper end of the ramp. As illustrated in, for example, FIG. 3, the second end of the frame is configured as at extension arms 26 so as to leave an opening 85 across the width of the ramp suitable to receive the lower steps in the step arrangement, whereby the fourth end 35B of the ramp can be placed sufficiently close to the upper one of the steps to generally abut the upper step.

To use the lift device, a user, such as in a wheel chair, advances the wheel chair from the underlying surface, e.g. ground, across arresting plate 54, onto ramp 14, stopping the wheel chair with the front wheels on sloping section 48 and the rear wheels on the generally horizontal section 52 as illustrated in dashed outline in FIG. 3.

The user then activates the control 75, activating hydraulic cylinder 16, and thus raising ramp 14 above the ground level. As illustrated, a first control button is used to start the lifting process, and a second control button on control 75 is used to stop the lifting process. Appropriate stops are built into the control system to prevent lifting to excessive height.

As hydraulic cylinder 16 begins to extend its ram, during the first stage of activation of lift device 10, pivotation brackets 80A, 80B pivot about pivot pins 82, carrying weight lifting bar 78 upwardly in an arc illustrated by arrow 100 and into engagement with ramp 14 at cross member 40L. During such first stage of activation of the lift device, such pivotation of brackets 80, until lifting bar 78 comes into contact with cross member 40L, transfers no lifting force, or substantially no lifting force, to the ramp. At the same time as brackets 80 are pivoting weight lifting bar 78 into position to contact cross member 40L, bracket 80B pivots chain arm 84 into an upright orientation. As chain arm 84 is raised into an upright position, it retracts chain 90, pulling on gravity locking bracket 62, and thus on arresting plate 54. Arresting plate 54 pivots about pivot pin 60, lifting the arresting plate to a raised orientation, and aligning locking flange 64 on locking bracket 62 with locking recess 74 on locking receptacle 66. The relative positions of the hydraulic cylinder, weight lifting bar 78, pivotation brackets 80, chain arm 84, and chain 90, at the end of the first stage of operation of the lift device, are shown in FIG. 7. The end result of the first stage of activation of lift device 10 is to raise arresting plate 54, which is accomplished by the time weight lifting bar 78 contacts cross member 40L and before any upward movement of ramp 14, typically before any upward force is applied to ramp 14.

As hydraulic cylinder 16 continues to extend the ram and after the arresting plate is lifted, the effective lifting force of the ram is applied at lifting bar 78, and transferred thence from bar 78 into cross member 40L. From cross member 40L, the force of the ram is transferred to stringers 38A, 38B, and thence throughout ramp 14 including to ramp plate 34. The lifting force thus lifts the third end 35A of the ramp, as the ramp pivots about pivot pin 36. As the third end of the ramp is lifted to a higher elevation, the angle "A" between the ramp and the ground is reduced.

As the lower end 35A of the ramp is lifted off the ground, the ground recedes from stop 76, releasing the locking receptacle to rotate downwardly by gravity, whereby locking recess 74 engages and locks-in locking flange 64, mechanically locking arresting plate 54 in the raised orientation for the duration of time the third end of the ramp is lifted.

Preferably, the lifting is continued until the sloping section of the ramp is in a generally horizontal orientation. The lifting is then stopped at the desired height, and the wheel chair is advanced to the fourth end of the ramp, and thence off the ramp and onto and across the upper surface of the tread of the respective step.

With the lifting stopped, and after the pre-set delay, the hydraulic fluid bleeds back out of the receiving chamber in the hydraulic cylinder, whereby gravity draws the third end 35A of the ramp back to the ground, ready for the next lift.

As the third end 35A approaches the ground, stop 76 engages the ground, raising locking receptacle 66 and thereby releasing locking flange 64. As the ram continues to recede into cylinder 16, pivotation brackets 80A, 80B pivot about pivot pins 82. Such pivotation accordingly pivots chain arm 84, extending chain 90 and thereby releasing arresting plate 54 to return to its horizontal orientation by gravity, the horizontal orientation being illustrated in FIG. 5.

With the ramp in the down orientation, as in FIG. 3, the ramp can readily be negotiated downwardly by a person in a wheel chair using suitable braking apparatus on the chair. Thus, the ramp is preferably negotiated for downward movement thereacross without activating the lifting capability of the lift devicem although the lifting capabiity can be activated if desired.

As seen from the foregoing description, and in combination with the drawings, the power from hydraulic cylinder 16 traverses a first linkage comprising lifting bar 78, pivotation brackets 80, and thence through chain arm 84 and chain 90 to a first terminal end at aperture 65, to thereby lift arresting plate 54. By contrast, the power from hydraulic cylinder 16 traverses a second and different linkage comprising lifting bar 78, to a second terminal end at the interface of lifting bar 78 with cross member 40L, to thereby lift ramp 14.

Similarly, it is seen from tracing the above linkages, that the force used to lift ramp 14 is not imposed, beyond lift bar 78, on the linkage used to lift arresting plate 54. Thus, the force used to power lifting of the ramp through the second linkage is not imposed on those portions of the second linkage downstream from lifting bar 78. Accordingly, locking bracket 62, including aperture 65, is not exposed to the force used to lift the ramp, but is exposed only to the minimal amount of force needed to raise arresting plate 54.

Materials used for the various elements of lift device 10 generally correspond with materials used for known conventional wheel chair lift devices. Accordingly, lift frame 12 and ramp 14 are typically metal. Suitable alloys are selected according to the environment in which the lift device will be used. Suitable thicknesses and the like are selected for the respective elements in view of the alloys selected, and the weight to be lifted.

The terms "ground," "ground-engaging," and the like include any underlying supporting surface, including ground, ground-level floor, platform, concrete or like surface, as well as such surfaces at elevated locations, for examples second and higher floors of buildings.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the invention.

Having thus described the invention, what is claimed is:

1. A pivoting wheel chair lift device articulated and powered to pivot about an upper end thereof from an inclined orientation to a horizontal orientation and thereby to lift a person in a wheel chair from a lower elevation to a higher elevation, said pivoting wheel chair device comprising:

(a) a frame, having a first lower, ground engaging end, a second upper end laterally displaced from said first end and disposed at a higher elevation than said first end;

(b) a ramp, having a third end disposed toward said first end of said frame, said ramp having a fourth opposing upper end mounted to said frame adjacent said second end of said frame, for pivotation of said ramp about said second end of said frame; and (c) lift powering apparatus operable to lift said third end of said ramp from a lowered position in which said ramp describes an inclined angle between a first lower elevation at said third end of said ramp and a second higher elevation at said fourth end of said ramp, to a lifted position in which said third end of said ramp is lifted to an elevation higher than the first elevation, said frame generally engaging the ground, extending upwardly from the ground adjacent said second end of said frame to define an opening across a width of said ramp at said fourth end of said ramp, sufficient to receive a first step, extending across the width of said ramp, such that said fourth end of said ramp can extend over a step and abut an upper step such that an upper surface at said fourth end of said ramp is aligned with an upper surface of a tread of an upper one of the steps.

2. A pivoting wheel chair lift device as in claim 1, said wheel chair lift device being readily transportable from place to place, requiring only placement of said wheel chair lift device on a suitable surface in the desired location, and connecting an associated power cord to suitable source of electricity thereby to power said lift powering apparatus.

3. A pivoting wheel chair lift device as in claim 1 wherein said lift powering apparatus is mounted to said frame.

4. A pivoting wheel chair lift device as in claim 1, including a control apparatus activating said lift powering apparatus, and thereby activating said wheel chair lift device.

5. A pivoting wheel chair lift device as in claim 1 wherein said lift device is a modular self-contained unit requiring, for installation, only placement on suitable surface and connection to power supply.

6. A pivoting wheel chair lift device as in claim 1 wherein said ramp includes an entrance element, generally parallel with the ground when said third end of said ramp is in ground-engaging disposition, extending inwardly from said third end of said ramp, and a rising element extending from said entrance element toward said fourth end of said ramp at an upwardly inclined angle to the ground when said third end of said ramp is in ground-engaging disposition.

7. A pivoting wheel chair lift device as in claim 6, said rising element having a first section adjacent said entrance element, a second section displaced from said entrance element, and a locus of joinder of said first and second sections such that said first section is between said entrance element and said second section, said upwardly inclining angle being defined at the locus of joinder.

8. A pivoting wheel chair lift device as in claim 7 wherein the angle between said entrance element and said rising element is about 5 degrees to about 20 degrees.

9. A pivoting wheel chair lift device as in claim 7 wherein the angle between said entrance element and said rising element is about 8 degrees to about 15 degrees.

10. A pivoting wheel chair lift device as in claim 1, further comprising an arresting plate.

11. A pivoting wheel chair lift device as in claim 10, additionally comprising a gravity locking bracket on said arresting plate, a locking receptacle on said ramp, which engages said locking bracket as said third end of said ramp is lifted, thereby mechanically locking said arresting plate in raised orientation when said third end of said ramp is lifted.

12. A pivoting wheel chair lift device as in claim 1, including adjustment apparatus for adjusting height of said fourth end of said ramp.

13. A pivoting wheel chair lift device as in claim 1, said lift powering apparatus being disposed beneath said ramp thereby to apply lifting force to said ramp at a locus below a top surface of said ramp.

14. A pivoting wheel chair lift device as in claim 13, further including a lifting bar connected to said lift powering apparatus and extending substantially across the width of said ramp providing a lifting engagement under said ramp thus to support a bottom surface of said ramp thereby supporting said ramp and applying lift force from said lift powering apparatus to said ramp.

15. A pivoting wheel chair lift device articulated and powered to pivot about an upper end thereof from an inclined orientation to a horizontal orientation and thereby to lift a person in a wheel chair from a lower elevation to a higher elevation, said pivoting wheel chair device comprising:

(a) a frame, having a first lower, ground engaging end, a second upper end laterally displaced from said first end and disposed at a higher elevation than said first end;

(b) a ramp, having a third ground-engaging end disposed toward said first end of said frame, said ramp having a fourth opposing upper end mounted to said frame for pivotation of said ramp about said second end of said frame, said fourth end of said ramp being laterally displaced from said third end of said ramp, and disposed at a higher elevation than said third end of said ramp when said third end of said ramp is in a lowered position, such that said ramp defines an inclined orientation between said third and fourth ends of said ramp when said ramp is in a lowered disposition;

(c) an arresting plate, said arresting plate having a fifth end mounted to said third ground-engaging end of said ramp, and a sixth opposing tail end remote from said third ground-engaging end of said ramp, said arresting plate being mounted for pivotation about said first ground-engaging end of said ramp, from a first horizontal orientation to a lifted orientation wherein said sixth tail end is above said fifth end thereof, for arresting egress of a wheel chair from said third end of said ramp; and (d) lift powering apparatus, powering said arresting plate and said ramp through divergent first and second linkages having first and second separate terminal ends thereof operative to lift said sixth tail end of said arresting plate and said third end of said ramp, respectively.

16. A pivoting wheel chair lift device as in claim 15, said wheel chair lift device being readily transportable from place to place, requiring only placement of said wheel chair lift device on a suitable surface in the desired location, and connecting an associated power cord to suitable source of electricity thereby to power said lift powering apparatus.

17. A pivoting wheel chair lift device as in claim 15 wherein said lift powering apparatus is mounted to said frame.

18. A pivoting wheel chair lift device as in claim 15, including a control apparatus activating said lift powering apparatus, and thereby activating said wheel chair lift device.

19. A pivoting wheel chair lift device as in claim 15 wherein said lift device is a modular self-contained unit requiring, for installation, only placement on suitable surface and connection to power supply.

20. A pivoting wheel chair lift device as in claim 15 wherein said ramp includes an entrance element, generally parallel with the ground when said third end of said ramp is in ground-engaging disposition, extending inwardly from said third end of said ramp, and a rising element extending from said entrance element toward said fourth end of said ramp at an upwardly inclined angle to the ground when said third end of said ramp is in ground-engaging disposition.

21. A pivoting wheel chair lift device as in claim 20, said rising element having a first section adjacent said entrance element, a second section displaced from said entrance element, and a locus of joinder of said first and second sections such that said first section is between said entrance element and said second section, said upwardly inclining angle being defined at the locus of joinder.

22. A pivoting wheel chair lift device as in claim 21, wherein the angle between said entrance element and said rising element is about 5 degrees to about 20 degrees.

23. A pivoting wheel chair lift device as in claim 21, wherein the angle between said entrance element and said rising element is about 8 degrees to about 15 degrees.

24. A pivoting wheel chair lift device as in claim 15, additionally comprising a gravity locking bracket on said arresting plate, a locking receptacle on said ramp, which engages said locking bracket as said third end of said ramp is lifted, thereby mechanically locking said arresting plate in raised orientation when said third end of said ramp is lifted.

25. A pivoting wheel chair lift device as in claim 15, including adjustment apparatus for adjusting height of said second end of said ramp.

26. A pivoting wheel chair lift device as in claim 15, said frame generally engaging the ground, extending upwardly from the ground adjacent said second end of said frame to define an opening across a width of said ramp at said fourth end of said ramp, sufficient to receive a first step, extending across the width of said ramp, such that said fourth end of said ramp can extend over a raised step and abut a second upper one of the steps such that an upper surface of said ramp at said fourth end of said ramp is aligned with the upper surface of a tread of the upper one of the steps.

27. A pivoting wheel chair lift device as in claim 15, said lift powering apparatus being disposed beneath said ramp thereby to apply lifting force to said ramp at a locus below a top surface of said ramp.

28. A pivoting wheel chair lift device as in claim 27, further including a lifting bar connected to said lift powering apparatus and extending substantially across the width of said ramp providing a lifting engagement under said ramp thus to support a bottom surface of said ramp thereby supporting said ramp and applying lift force from said lift powering apparatus to said ramp.

29. A pivoting wheel chair lift device, comprising:

(a) a frame, having a first lower, ground engaging end, a second upper end laterally displaced from said first end and disposed at a higher elevation than said first end;

(b) a ramp, having a third ground-engaging end disposed toward said first end of said frame, said ramp having a fourth opposing upper end mounted to said frame for pivotation of said ramp about said second end of said frame, said fourth end of said ramp being laterally displaced from said third end of said ramp, and disposed at a higher elevation than said third end of said ramp when said third end of said ramp is in a lowered position, such that said ramp defines an inclined orientation between said third and fourth ends of said ramp when said ramp is in a lowered disposition;

(c) an arresting plate, said arresting plate having a fifth end mounted to said third ground-engaging end of said ramp, and a sixth opposing tail end remote from said third ground-engaging end of said ramp, said arresting plate being mounted for pivotation about said third ground-engaging end of said ramp, from a first horizontal orientation to a lifted orientation wherein said sixth tail end is above said fifth end thereof, for arresting egress of a wheel chair from said third end of said ramp; and (d) lift powering apparatus, powering said arresting plate through a first linkage to a first terminal end at said arresting plate using a first force, and powering said ramp through a second linkage using a second force without exposing said first terminal end to the second force, to thereby lift said tail end of said arresting plate and said first end of said ramp.

30. A pivoting wheel chair lift device as in claim 29, said wheel chair lift device being readily transportable from place to place, requiring only placement of said wheel chair lift device on a suitable surface in the desired location, and connecting an associated power cord to suitable source of electricity thereby to power said lift powering apparatus.

31. A pivoting wheel chair lift device as in claim 29 wherein said lift powering apparatus is mounted to said frame.

32. A pivoting wheel chair lift device as in claim 29, including a control apparatus activating said lift powering apparatus, and thereby activating said wheel chair lift device.

33. A pivoting wheel chair lift device as in claim 29 wherein said lift device is a modular self-contained unit requiring, for installation, only placement on suitable surface and connection to power supply.

34. A pivoting wheel chair lift device as in claim 29 wherein said ramp includes an entrance element, generally parallel with the ground when said third end of said ramp is in ground-engaging disposition, extending inwardly from said third end of said ramp, and a rising element extending from said entrance element toward said fourth end of said ramp at an upwardly inclined angle to the ground when said third end of said ramp is in ground-engaging disposition.

35. A pivoting wheel chair lift device as in claim 34, said rising element having a first section adjacent said entrance element, a second section displaced from said entrance element, and a locus of joinder of said first and second sections such that said first section is between said entrance element and said second section, said upwardly inclining angle being defined at the locus of joinder.

36. A pivoting wheel chair lift device as in claim 35 wherein the angle between said entrance element and said rising element is about 5 degrees to about 20 degrees.

37. A pivoting wheel chair lift device as in claim 35 wherein the angle between said entrance element and said rising element is about 8 degrees to about 15 degrees.

38. A pivoting wheel chair lift device as in claim 29 additionally comprising a gravity locking bracket on said arresting plate, a locking receptacle on said ramp, which engages said locking bracket as said third end of said ramp is lifted, thereby mechanically locking said arresting plate in raised orientation when said third end of said ramp is lifted.

39. A pivoting wheel chair lift device as in claim 29, including adjustment apparatus for adjusting height of said second end of said ramp.

40. A pivoting wheel chair lift device as in claim 29, said frame generally engaging the ground, extending upwardly from the ground adjacent said second end of said frame to define an opening across a width of said ramp at said fourth end of said ramp, sufficient to receive a first step, extending across the width of said ramp, such that said fourth end of said ramp can extend over a raised step and abut a second upper one of the steps such that an upper surface of said ramp at said fourth end of said ramp is aligned with the upper surface of a tread of the upper one of the steps.

41. A pivoting wheel chair lift device as in claim 29, said lift powering apparatus being disposed beneath said ramp thereby to apply lifting force to said ramp at a locus below a top surface of said ramp.

42. A pivoting wheel chair lift device as in claim 41, further including a lifting bar connected to said lift powering apparatus and extending substantially across the width of said ramp providing a lifting engagement under said ramp thus to support a bottom surface of said ramp thereby supporting said ramp and applying lift force from said lift powering apparatus to said ramp.

43. A method of negotiating steps with a wheel chair, the method comprising the steps of:

(a) placing a pivoting wheel chair lift device propinquant an upper one of a set of steps, the pivoting wheel chair lift device comprising (i) a frame having a first lower, ground engaging end, a second upper end laterally displaced from the first end and disposed at a higher elevation than the first end, (ii) a ramp, having an upper surface thereof, having a third end at ground level adjacent the first end of the frame and a fourth opposing upper end mounted to the frame adjacent the second end of the frame for pivotation of the ramp about the second end of the frame, the fourth end of the upper surface of the ramp being disposed substantially at the elevation of the upper surface of the tread of the upper one of the steps such that the ramp describes a first inclined angle between the third and fourth ends thereof, (iii) lift powering apparatus operable to lift the third end of the ramp from ground level to a higher elevation; and (iv) control apparatus for activating the lift powering apparatus, and thereby lifting the wheel chair ramp;

(b) advancing a wheel chair onto the ramp at the first lower end of the ramp while the ramp is inclined between ground level at the third end of the ramp and step level at the fourth end of the ramp;

(c) after advancing the wheel chair onto the ramp, activating the control apparatus to thereby lift the third end of the ramp above ground level; with corresponding pivoting of the fourth end of the ramp to thereby reduce the angle of incline; and (d) advancing the wheel chair to the fourth end of the ramp along a second angle less than the first angle, thence onto and across the upper one of the steps, thereby negotiating the steps.

44. A method of negotiating steps with a wheel chair as in claim 43, the ramp having a first section generally parallel with the ground and extending inwardly from the third end of the ramp, and a second section extending from the first section toward the fourth end of the ramp at an upwardly inclined angle to the ground and including the step of advancing the wheel chair onto the first section in step (b), and activating the control apparatus in step (c) while at least part of the wheel chair is supported on the first section.

45. A method of negotiating steps with a wheel chair as in claim 43, the wheel chair lift device of step (a) including an arresting plate.

46. A method of negotiating steps with a wheel chair as in claim 45, the arresting plate and the ramp in combination having a gravity locking bracket and a corresponding and cooperating locking receptacle for engagement with each other as the third end of the ramp is lifted, the method including the step of engaging the locking bracket and the locking receptacle together, and thus locking the arresting plate in raised orientation when the third end of the ramp is lifted above ground level.

47. A method of negotiating steps with a wheel chair as in claim 43, the wheel chair lift device being transportable from place to place, and including the steps of placing the lift chair device on a suitable surface in the desired location as in step (a), and connecting an associated power cord to the suitable source of electricity and thereby providing a power source to the lift powering apparatus.

* * * * *